US010147318B2

(12) United States Patent
Gebers

(10) Patent No.: US 10,147,318 B2
(45) Date of Patent: Dec. 4, 2018

(54) EMERGENCY VEHICLE NOTIFICATION SYSTEM

(71) Applicant: EchoStar Technologies International Corporation, Englewood, CO (US)

(72) Inventor: Scott Gebers, Englewood, CO (US)

(73) Assignee: ECHOSTAR TECHNOLOGIES INTERNATIONAL CORPORATION, Englewood, CO (US)

( * ) Notice: Subject to any disclaimer, the term of this patent is extended or adjusted under 35 U.S.C. 154(b) by 0 days.

(21) Appl. No.: 15/461,989

(22) Filed: Mar. 17, 2017

(65) Prior Publication Data

US 2018/0268690 A1 Sep. 20, 2018

(51) Int. Cl.
*G08G 1/0965* (2006.01)
*G08G 1/16* (2006.01)

(52) U.S. Cl.
CPC ..... *G08G 1/0965* (2013.01); *G08G 1/161* (2013.01)

(58) Field of Classification Search
CPC ..... G08G 1/0965; G08G 1/161
USPC ..... 340/902
See application file for complete search history.

(56) References Cited

U.S. PATENT DOCUMENTS 6,087,961 A * 7/2000 Markow ..... G08G 1/0965 340/902
6,326,903 B1 * 12/2001 Gross ..... G08G 1/087 340/902
6,333,703 B1 * 12/2001 Alewine ..... G08G 1/01 340/905
6,529,831 B1 * 3/2003 Smith ..... G08G 1/162 340/903
6,700,504 B1 * 3/2004 Aslandogan ..... G08G 1/087 340/901
6,917,306 B2 * 7/2005 Lilja ..... G08G 1/0965 340/436
7,099,776 B2 * 8/2006 King ..... G08G 1/0965 340/902
7,515,065 B1 * 4/2009 Bygrave ..... G08G 1/0965 340/901
7,545,261 B1 * 6/2009 Harrington ..... G08G 1/163 340/435
8,350,721 B2 * 1/2013 Carr ..... G08G 1/205 340/902
2001/0038344 A1 * 11/2001 Garcia ..... G08G 1/0965 340/902
2003/0043056 A1 * 3/2003 Siegel ..... G08G 1/0965 340/902

(Continued)

*Primary Examiner* — Adnan Aziz
(74) *Attorney, Agent, or Firm* — Nath, Goldberg & Meyer; Leonid D. Thenor

(57) ABSTRACT

A system for alerting drivers to the presence of oncoming emergency vehicles. According to an embodiment, the system includes: a first transceiver located in an emergency vehicle for transmitting GPS coordinates of the emergency vehicle, and second transceiver located in an automobile. The second transceiver is receives the transmitted information and determines a proximity of the emergency vehicle relative to the automobile. If the emergency vehicle is within a predetermined proximity of the automobile, the second transceiver causes selective attenuation of audio and video signals currently being output in order to raise driver awareness to audio/video alerts generated by the emergency vehicle.

17 Claims, 8 Drawing Sheets

(56) References Cited

U.S. PATENT DOCUMENTS

2004/0155795 A1* 8/2004 Quintana ..... G08G 1/0965 340/902
2005/0093717 A1* 5/2005 Lilja ..... G08G 1/0965 340/902
2007/0132608 A1* 6/2007 Votaw ..... G08G 1/0965 340/903
2007/0159354 A1* 7/2007 Rosenberg ..... G08G 1/0965 340/902
2008/0106435 A1* 5/2008 Kirkpatrick ..... G08G 1/0965 340/902
2008/0303660 A1* 12/2008 Lombardi ..... G08G 1/0965 340/540
2009/0066538 A1* 3/2009 Thomas ..... G06Q 30/0266 340/903
2010/0240302 A1* 9/2010 Buczkiewicz ..... H04B 1/034 455/11.1
2010/0292886 A1* 11/2010 Szczerba ..... G01C 21/365 701/31.4
2011/0187559 A1* 8/2011 Applebaum ..... B60Q 1/00 340/907
2011/0241923 A1* 10/2011 Chernukhin ..... G01S 7/022 342/20
2012/0313792 A1* 12/2012 Behm ..... G08G 1/0965 340/902
2014/0070962 A1* 3/2014 Holland ..... G08G 1/0965 340/902
2014/0085107 A1* 3/2014 Gutierrez ..... G08G 1/096766 340/905
2014/0236483 A1* 8/2014 Beaurepaire ..... G01C 21/3626 701/533
2014/0354449 A1* 12/2014 Alam ..... G08G 1/0965 340/902
2015/0254978 A1* 9/2015 Mawbey ..... G08G 1/092 340/902
2015/0371539 A1* 12/2015 Hawkins, Sr. ..... G08G 1/0962 340/902
2016/0098926 A1* 4/2016 Probert ..... G01S 19/17 340/903
2016/0253903 A1* 9/2016 Wilk ..... G08G 1/0965 340/902
2017/0008455 A1* 1/2017 Goudy ..... B60Q 9/008

* cited by examiner

EMERGENCY VEHICLE NOTIFICATION SYSTEM

BACKGROUND INFORMATION

The increased use of automobile has resulted in an increased number of accidents on today's streets and highways. Collisions between emergency vehicles and consumer automobiles have also increased dramatically. Many of the collisions with emergency vehicles result from driver distraction or inability to perceive warnings (e.g., lights, siren, etc.) generated by the emergency vehicle. For example, it may be difficult for a driver to visually perceive lights from an emergency vehicle that is approaching an intersection from a crossing path. This can be further complicated if the driver is engaged in listening to loud music, because the siren would also go unnoticed.

Many of the emerging technologies designed to diversify and enhance certain automotive functions have also contributed to some of these collisions. Unlike previous generations that only included cd receivers, modern automobiles typically include infotainment systems that allow occupants to control audio and video functions throughout the entire automobile. For example, front seat passengers can listen to audio entertainment, while rear seat passengers watch videos. Most, if not all, of the audio/video functions within the automobile are accessible by the driver via the main controls of the infotainment system. Many infotainment systems are also touch enabled, thus allowing occupants to make selections without the use of mechanical controls.

Navigation systems are an additional option that is becoming increasingly available in automobiles. The navigation system effectively eliminates the use of printed maps and directions by displaying the automobile's position within a digitally constructed map of the surrounding area in real time. GPS coordinate data is received by the automobile's infotainment system and used to determine the location, heading, velocity, etc. As the automobile travels along a street or highway, the map is dynamically updated to reflect its position and surroundings. Navigation systems can also provide voice guidance to a particular address that is input, stored in memory, or designated as a point of interest. Touch enabled infotainment systems also allow drivers to performing map functions (e.g., select, scroll, zoom, etc.) by touching the display screen in predetermined manners.

Such enhancements can sometimes demand excessive attention from the driver, and other times provide a calm sanctuary. Additionally, modern automobiles are well insulated from external noise by mechanical (e.g., sound insulation) and sometimes electronic (e.g., active/passive noise cancellation) enhancements. The combination of audio/visual entertainment and sound insulation can create an environment where drivers become unaware of external factors. Consequently, drivers are often unaware of approaching emergency vehicles, thus contributing to collisions. Such collisions result in injuries to occupants of the automobile and delay response times for actual emergencies. Furthermore, emergency vehicles are often hesitant to approach intersections because they cannot be certain if all drivers are aware of their presence, thereby further delaying response time.

Based on the foregoing, there is a need for an approach for alerting and/or directing driver attention to the presence of oncoming emergency vehicles.

BRIEF SUMMARY

A system and method are disclosed for alerting drivers to the presence of oncoming emergency vehicles. According to an embodiment, the system includes: a first transceiver located in an emergency vehicle for transmitting information corresponding, at least in part, to GPS coordinates of the emergency vehicle; and second transceiver located in an automobile and configured to: receive the transmitted information, determine a proximity of the emergency vehicle relative to the automobile based, at least in part, on the received information, output an interrupt signal, if the emergency vehicle is within a predetermined proximity thereof, and cause the infotainment system to selectively attenuate audio and video signals currently being output in response to the interrupt signal, thereby raising driver awareness to audio/video alerts generated by the emergency vehicle.

According to another embodiment, the method includes: transmitting, from an emergency vehicle, information corresponding, at least in part, to GPS coordinates of the emergency vehicle; receiving the transmitted information at an automobile; determining a proximity of the emergency vehicle relative to the automobile based, at least in part, on the received information; outputting an interrupt signal to an infotainment system in the automobile, if the emergency vehicle is within a predetermined proximity thereof; and selectively attenuating audio and video signals currently being output by the infotainment system in response to the interrupt signal, thereby raising driver awareness to audio/video alerts generated by the emergency vehicle.

The foregoing summary is only intended to provide a brief introduction to selected features that are described in greater detail below in the detailed description. As such, this summary is not intended to identify, represent, or highlight features believed to be key or essential to the claimed subject matter. Furthermore, this summary is not intended to be used as an aid in determining the scope of the claimed subject matter.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DETAILED DESCRIPTION

A system and method for alerting drivers to the presence of oncoming emergency vehicles are described. In the following description, for purposes of explanation, numerous specific details are set forth in order to provide a thorough understanding of the disclosed embodiments. It will become apparent, however, to one skilled in the art that various embodiments may be practiced without these specific details or with an equivalent arrangement. In other instances, well-known structures and devices are shown in block diagram form in order to avoid unnecessarily obscuring the various embodiments.

Figure 1:
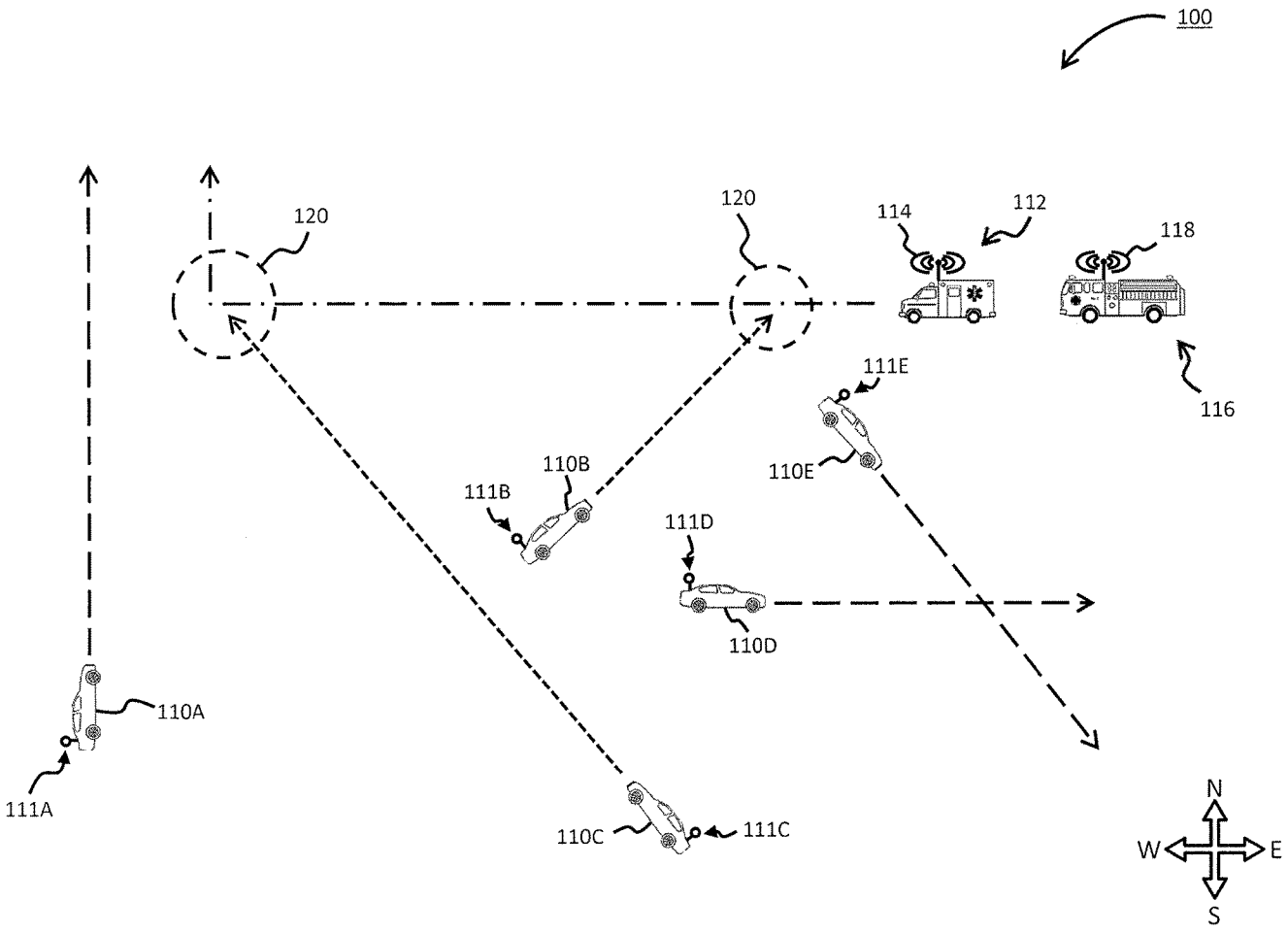
FIG. 1 is a diagram of a system capable of alerting drivers to the presence of oncoming emergency vehicles, according to one embodiment.

FIG. 1 illustrates a system for alerting drivers to the presence of oncoming emergency vehicles. The system depicts interaction of multiple automobiles 110A-11E (collectively 110) with various emergency vehicles such as an ambulance 112 and a fire truck 116. Five automobiles are illustrated with different headings represented by dashed lines. According to the illustrated embodiment, the first automobile 110A is heading in a northward direction. The direction can represent, for example, a particular street in the local area where traffic runs in north and south directions. The second automobile 110B is traveling in a northeast direction, while the third automobile 100C is traveling in a northwest direction. As illustrated in FIG. 1, a fourth automobile 110D is traveling in an easterly direction, and a fifth automobile 110E is traveling in a southeast direction. Depending on specific road conditions and traffic regulations, each of the automobiles 110A-110E may be traveling at different speeds. For example, the first automobile may be traveling at a speed of 55 miles per hour (mph), whereas the third automobile 110C may be traveling at 35 mph.

FIG. 1 further illustrates the ambulance 112 and fire truck 116 traveling in a westerly direction. Based on current speed and headings for the illustrated embodiment, it is probable that the second automobile 110B will arrive at intersection 120 at approximately the same time as the ambulance 112 and a fire truck 116. Similarly, it is probable that the third automobile 110C will arrive at a second intersection 122 at approximately the same time as the ambulance 112 and fire truck 116. As previously discussed, a common problem exists wherein automobiles that are either at an intersection, or approaching an intersection, are unaware of the existence of emergency vehicles (112, 116) that may be approaching the same intersection, despite the use of traditional signaling methods such as a siren and/or flashing lights.

According to at least one embodiment, the ambulance 112 can include a transmitter 114 capable of transmitting its GPS information within a predetermined range. For example, transmitter 114 may allow the ambulance 112 to transmit GPS information within a radius of 1 mile. It should be noted, however, that this distance can vary depending on various factors, including at least location and city type (urban, suburban, rural, etc.). For example, an emergency vehicle 112, 116 operating within a rural area, where intersections are distant from each other and local speeds are high, may be configured to transmit within a range of 2 miles or greater. In contrast, urban settings having intersections much more closely spaced may warrant a reduced range such as ½ mile or less. As illustrated in FIG. 1, the fire truck 116 can also include a transmitter 118 capable of transmitting its GPS information in a manner similar to that previously described with respect to the ambulance 112. Depending on the specific implementation, the ambulance 112 and fire Truck 116 may utilize transceivers instead of a transmitter in order to provide both transmit and receive capabilities. Thus, the term transmitter can be used interchangeably with transceiver herein.

According to at least one embodiment, transmitters 114 and 118 can be in the form of radio frequency transmitters which broadcast the GPS information corresponding to the emergency vehicles 112, 116 to any automobile 110 within the predetermined proximity. The transmitters 114, 118 can also utilize a variety of frequency spectrum options. For example, the transmitters 114, 118 can transmit GPS information utilizing any free FM stereo channels that can be accessed using a conventional radio receiver. According to such embodiments, each automobile 110 can be configured to include a receiver 111 capable of automatically scanning the unused FM channels in order to detect transmission of the GPS information from any approaching emergency vehicles 112, 116. According to further embodiments, the transmitter 114, 118 can utilize public emergency channels that are available nationwide. According to such embodiments, each automobile 110 can be equipped with a transceiver (or receiver) 111 capable of monitoring and receiving information from the public emergency channels being used by the emergency vehicles 112, 116. According to still further embodiments, privately owned frequency spectrum can be utilized to transmit the GPS information from the emergency vehicles 112, 116. According to such embodiments, both the emergency vehicles 112, 116 and automobiles 110 would be configured to include transceivers capable of utilizing and monitoring various channels on the privately owned frequency spectrum.

According to at least one embodiment, the emergency vehicles 112, 116 will begin to broadcast GPS information pertaining to their location upon activating their emergency status. For example, when the emergency vehicle 112, 116 is responding to a call from a dispatch station, it will activate its emergency status, thereby resulting in flashing lights and/or siren. If the emergency vehicle 112, 116 is not responding to an emergency (e.g., returning to the home location), there is no need to engage the emergency status. Therefore, no flashing lights or siren would accompany the emergency vehicle 112, 116. Once the emergency status is activated, the emergency vehicle 112, 116 will continuously transmit GPS information corresponding to its instantaneous position. According to at least one embodiment, the GPS information can be transmitted every quarter second, one half second, one second, two seconds, etc. Based on the updated GPS information, it is possible to determine the precise location, heading, and velocity of the emergency vehicle 112, 116.

According to one or more embodiments, each automobile 110A-110E is configured to include, respectively, a receiver 111A-111E which allows it to receive the transmission originating from the emergency vehicle 112, 116. According to other embodiments, the automobiles 110 can include a transceiver (instead of a receiver) which facilitates transmission of their own GPS information, while also receiving GPS information from other automobiles 110 as well as the emergency vehicles 112, 116. As such, emergency vehicles 112, 116 that are also configured with transceivers can receive GPS information pertaining to the location of automobiles within their vicinity, thereby improving anticipation and reaction to traffic at upcoming intersections.

Referring again to FIG. 1, as the ambulance 112 approaches the first intersection, the range of its transmitter 114 may only encompass the second automobile 110B, the fourth automobile 110D, and the fifth automobile 110E. Thus, these three automobiles (110B, 110D, 110E) would receive the GPS information pertaining to the location of the ambulance 112. Using this information, the automobiles (110B, 110D, 110E) can determine the location and heading of the ambulance 112, and alert the driver to an impending approach.

According to the illustrated embodiment, the fourth automobile 110D is traveling from west to east along a road that is parallel to that being used by the ambulance 112. By using its own GPS information, together with the GPS information received from the ambulance, the fourth automobile 110D can conclude that its current path and speed will not intersect with the path of the ambulance 112. Similarly, the fifth automobile 110E can conclude that its path (southeast direction) will not intersect with the path of the ambulance 112. Warnings are, therefore, not provided to these drivers. The second automobile 110B, however, is traveling in a northeast direction at a velocity which will place it at the first intersection 120 at approximately the same time as the ambulance 112.

According to at least one embodiment, the receiver 111B (or transceiver) located in the second automobile 110B is configured to output an interrupt signal if it is determined that the emergency vehicles 112, 116 are within a predetermined proximity. For example, the interrupt signal can be output if the receiver 111B determines that the second automobile 110B is within ¼ mile, 2 blocks, etc., of the ambulance 112. The interrupt signal can be sent to the second automobile's infotainment system in order to redirect the driver's attention and/or alert the driver to the proximity of the emergency vehicles 112, 160. According to at least one embodiment, the infotainment system can selectively attenuate audio and video signals that are currently being output, upon receiving the interrupt signal. For example, the infotainment system may decrease, or completely mute, the volume of any audio signal that is currently being output in a manner that is audible by the driver. The infotainment system may also attenuate or mute all audio signals being output within the entire automobile. Similarly, the infotainment system may pause, or terminate, any video signals currently being output within the automobile.

Depending on the specific implementation, however, it may not be necessary to control certain video signals within the second automobile 110B. For example, some infotainment systems can include video display screens that are only viewable by rear passengers. Furthermore, such display screens may operate in conjunction with dedicated wired and/or wireless headsets. Thus, any audio or video being output to these video displays would not be perceived by the driver. Once the audio and video signals have been reduced or eliminated, the driver's awareness can be refocused such that any lights and/or sirens accompanying the emergency vehicles 112, 116 may be perceived. Therefore, as the second automobile 110B approaches the first intersection 120, the driver would become increasingly aware of the approaching ambulance 112 because all internal distractions have been reduced and/or eliminated. Furthermore, the driver can preemptively stop the second automobile 110B in order to allow the emergency vehicles 112, 116 to safely and quickly pass through the intersection without being overly concerned with potential collisions.

According to at least one embodiment, upon reducing or terminating all audio and video signals being output, the infotainment system can further generate auditable messages to alert the driver of the approaching emergency vehicle 112, 116. For example, the audio message can indicate the particular type of emergency vehicle (ambulance, fire truck, police, etc.), as well as the street along which the emergency vehicle 112, 116 is currently traveling. Furthermore, the audio message can inform the driver of the distance to the emergency vehicle 112, 116 and whether or not the emergency vehicle 112, 116 is traveling toward the driver or away from the driver. Conversely, the audio message can inform the driver whether their automobile 110 is heading toward or away from the emergency vehicle 112, 116.

As further indicated in FIG. 1, the path of the ambulance 112 will reach the second intersection 122 at a later point in time. When the ambulance 112 approaches the first intersection 120, the range of its GPS information may not be sufficient to reach the third automobile 110C. However, the paths of the ambulance 112 and the third automobile 110C will cross at the second intersection 122 based on their current heading and speed. As the ambulance 112 approaches the second intersection 122, the third automobile 110C will begin to receive the transmitted GPS information. The third automobile 110C would utilize the received information in conjunction with its own GPS information to determine when a minimum proximity (or distance) has been reached. At this point, the interrupt signal would be output in order to cause the infotainment system to attenuate or completely disable various audio and/or video signals being output within the third automobile 110C. The infotainment system can further output an audio message, as previously described, to provide the driver with various information regarding the oncoming emergency vehicle 112, 116.

Figure 2:
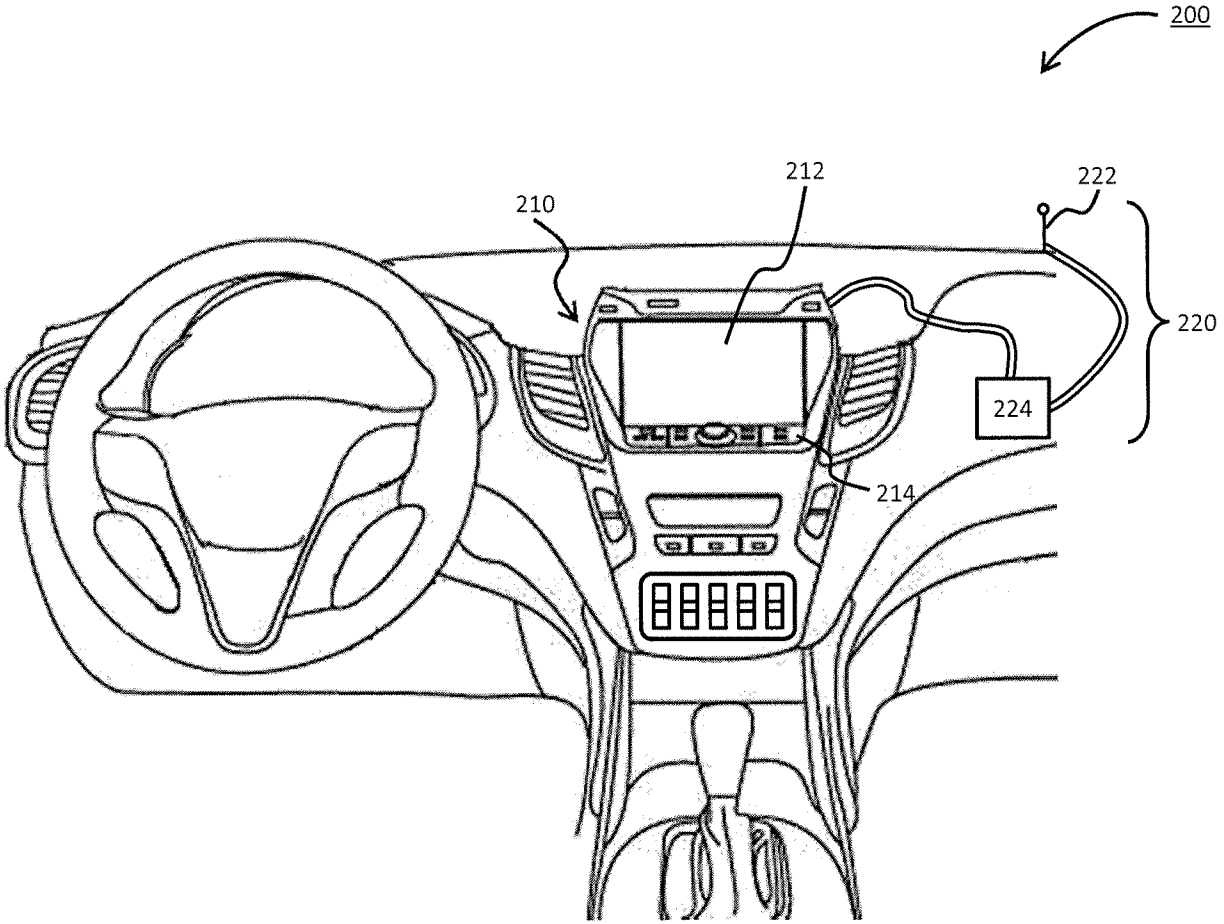
FIG. 2 is a diagram of automobile components for implementing one or more embodiments.

FIG. 2 illustrates various components of an automobile which can be used to implement features of various embodiments. As illustrated in FIG. 2, the automobile can be configured to include a dashboard 200 containing an infotainment system 210 having a large display screen 212. The infotainment system 210 can be operated using a variety of controls 214 that may be situated in the dashboard 200 and/or the center console of the automobile. Depending on the specific automobile model, the controls 214 can be in the form of knobs, buttons, switches, etc. Although not illustrated in FIG. 2, the infotainment system 210 can include one or more processors (e.g., CPU, controller, RISC chip, etc.) for managing and controlling its operations. Various infotainment systems 210 can also include display screens 212 that are touch activated. For example, a touch activated display screen 212 allows the driver to make various selections and/or adjustments by using one or more fingers to perform different gestures. Functions facilitated by the touch activated display screen 212 can also be redundantly implemented using one or more of the controls 214. The driver is also capable of controlling various audio features using the infotainment system 210. For example, the driver can select radio frequency bands (AM or FM), radio channels (or stations), volume, etc. Different sources of audio/video input can also be selected using the infotainment system 210. For example, a driver can select the radio, CD player, DVD player, auxiliary MP3 player, etc. as the source for supplying audio/video signals. Once selected, volume, track, chapter, album, etc. can be selected using the display screen 212 (if touch enabled) or the controls 214.

Infotainment systems 210 can also include built-in navigation systems that allow a driver to see a map representing the surrounding area and/or provide guidance to a specified destination. As will be discussed in greater detail below, inclusion of a navigation system can provide additional benefits and features with respect to the detection of approaching emergency vehicles. Depending on the specific configuration of the infotainment system 210, the built-in navigation system can be operated by touch and/or the controls 214. For example, if a driver wishes to specify a destination for driving guidance, a keyboard representation (i.e., soft keyboard) containing alpha-numeric characters can be displayed on the screen so that the destination can be entered. If the display screen 212 is touch enabled, the driver can simply utilize a finger to enter the required destination. Alternatively, a scroll knob or other input system can be used to select the appropriate letters and/or numbers required to define the desired destination. Additionally, if the infotainment system 210 includes voice recognition capabilities, the driver may use speech to enter the destination.

According to at least one embodiment, the automobile can include a receiver 220 capable of receiving GPS information transmitted by the emergency vehicles and interfacing with the infotainment system 210. As previously discussed, a transceiver can be interchangeably used in in place of the receiver 220 in order to further provide transmit functions to the automobile. As illustrated in FIG. 2, the receiver 220 can include an antenna 222 for receiving (and transmitting) various signals containing the GPS information.

The receiver 220 can also include a controller 224 to process information received by the antenna 222. According to at least one embodiment, the controller 224 can be interfaced with the infotainment system 210 in order to supply the received GPS information and control various operations associated with alerting and/or directing driver attention to the presence of oncoming emergency vehicles. The controller 224 can optionally be configured as middleware circuitry (e.g., hardware/software) which interfaces the hardware, software, and/or data with the infotainment system 210. For example, the controller 224 can instruct the infotainment system 210 to attenuate or terminate selected audio and/or video signals currently being output. The controller 224 may also generate and transmit instructions for displaying the emergency vehicles on the display 212 screen when the navigation system is active. The controller 224 can further supply instructions for displaying the traveled path and/or projected path of any relevant emergency vehicles, and outputting various alerts to the driver, as described herein. According to other embodiments, however, various features of the receiver 220 can be integrated into the infotainment system 210. For example, the standard antenna included with the automobile can be used to receive signals containing the GPS information. Furthermore, the controller or processing unit associated with the infotainment system 210 can be further programmed with instructions for displaying emergency vehicles and alerting the driver, as described herein.

Figure 3:
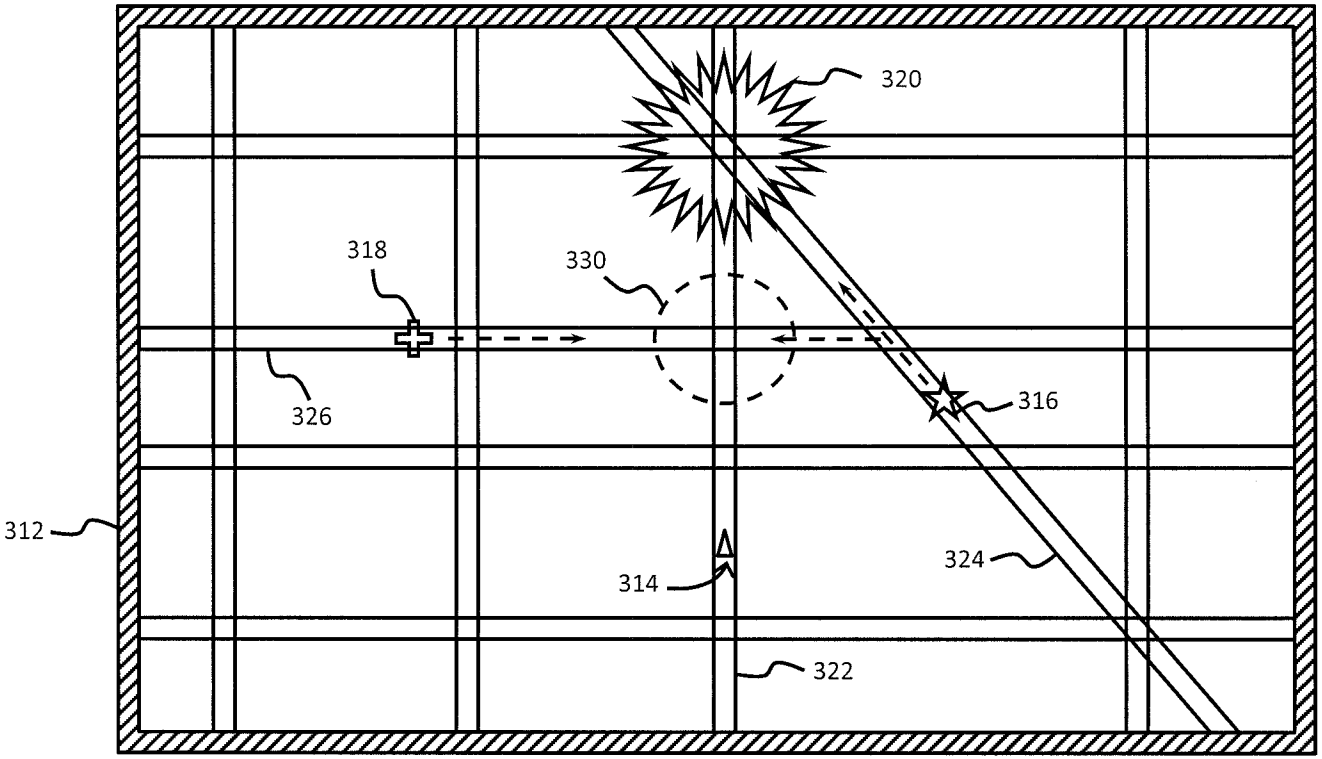
FIG. 3 is a diagram of an automobile navigation screen, according to one embodiment.

FIG. 3 illustrates exemplary contents of a display screen 312 when the navigation system has been activated. The display screen 312 illustrates a map containing various icons to represent, for example, the current automobile 314, a police vehicle 316, and an ambulance 318. As can be appreciated, additional icons may be displayed depending on specific traffic and/or emergency conditions. According to the illustrated embodiment, an accident has occurred at intersection 320. It should be noted that the accident at intersection 320 is shown in order to provide a visual representation of the current traffic situation. Depending on the specific automobile, the navigation system may not have any type of traffic information. Thus, the driver would have no indication of the emergency vehicles' headings. Certain navigation systems, however, are capable of retrieving current traffic information. Such navigation systems could display, for example, a visual representation of a congested traffic around intersection 320 using a particular color, shading, etc.

As illustrated in FIG. 3, the automobile is currently driving on street 322 in a direction toward the accident at intersection 320. Meanwhile, emergency vehicles such as the police vehicle 316 and the ambulance 318 have been dispatched, and are heading to the accident at intersection 320. The police vehicle 316 is traveling on street 324, which can lead directly to intersection 320. Depending on traffic conditions, however, the police vehicle 316 can also turn on street 326, and subsequently turn again on street 322 in order to arrive at intersection 320. The ambulance 318, however, is approaching from street 326 and will turn on street 322 in order to reach intersection 320.

According to the illustrated embodiment, the emergency vehicles 316, 318 are continuously broadcasting (or transmitting) GPS information pertaining to their location as they head to intersection 320. The automobile 314 receives the GPS information and performs the necessary processing to determine if either emergency vehicles 316, 318 is within the required proximity. If it is determined that either of the emergency vehicles 316, 318 is within the required proximity, then the necessary alerts can be provided to the driver. According to at least one embodiment, an interrupt signal can be supplied to the infotainment system in order to selectively attenuate audio and video signals currently being output. Furthermore, the infotainment system can activate the automobile's navigation system in order to display icons representing the police vehicle 316 and the ambulance 318. The icons can be placed on the map of the display screen 312 based on the GPS information received from these emergency vehicles 316, 318.

As previously discussed, the GPS information can be continually transmitted as the emergency vehicles 316, 318 are traveling to intersection 320. Accordingly, the location of the emergency vehicles 316, 318 relative to the automobile 314 can be updated in real time on the display screen 312. The driver would therefore be aware of the precise location of the emergency vehicles 316, 318 as they approach intersection 320. Additionally, the infotainment system can still output audio messages to alert the driver of the specific location of the emergency vehicles in the same manner as that previously discussed.

According to at least one embodiment, the GPS information received from the emergency vehicles 316, 318 can be used to extrapolate a projected path to further alert the driver of potential points of collision with the emergency vehicles 316, 318. As illustrated in FIG. 3, the projected path of the ambulance 318 shows the driver that a potential point of collision would exist at intersection 330 because the automobile 314 and the ambulance 318 would reach this intersection at approximately the same point in time. As previously discussed, potential points of collision can be determined based, at least in part, on current location, speed, heading, etc. of both the automobile 314 and any emergency vehicles 316, 318. Furthermore, changes in speed and direction can be continually monitored so that the location of all emergency vehicles 316, 318 can be updated on the display screen in real-time. The traveled and projected paths of the emergency vehicles 316, 318 can also be updated in real-time.

As illustrated in FIG. 3, the police vehicle 316 can take different routes to arrive at intersection 320. According to one or more embodiments, different projected paths can be shown on the display screen 312 for the police vehicle 316. If the police vehicle 316 turns at street 326, the path following street 324 would be eliminated. Alternatively, if the police vehicle 316 follows street 324 directly to intersection 320, the path on street 326 would be deleted. According to such features, a driver can advantageously determine the precise location of emergency vehicles 316, 318 as well as potential points of impact that can occur at different intersections. Furthermore, the driver can have a visual representation of the location and number of emergency vehicles 316, 318 that are currently within the predetermined proximity.

Figure 4:
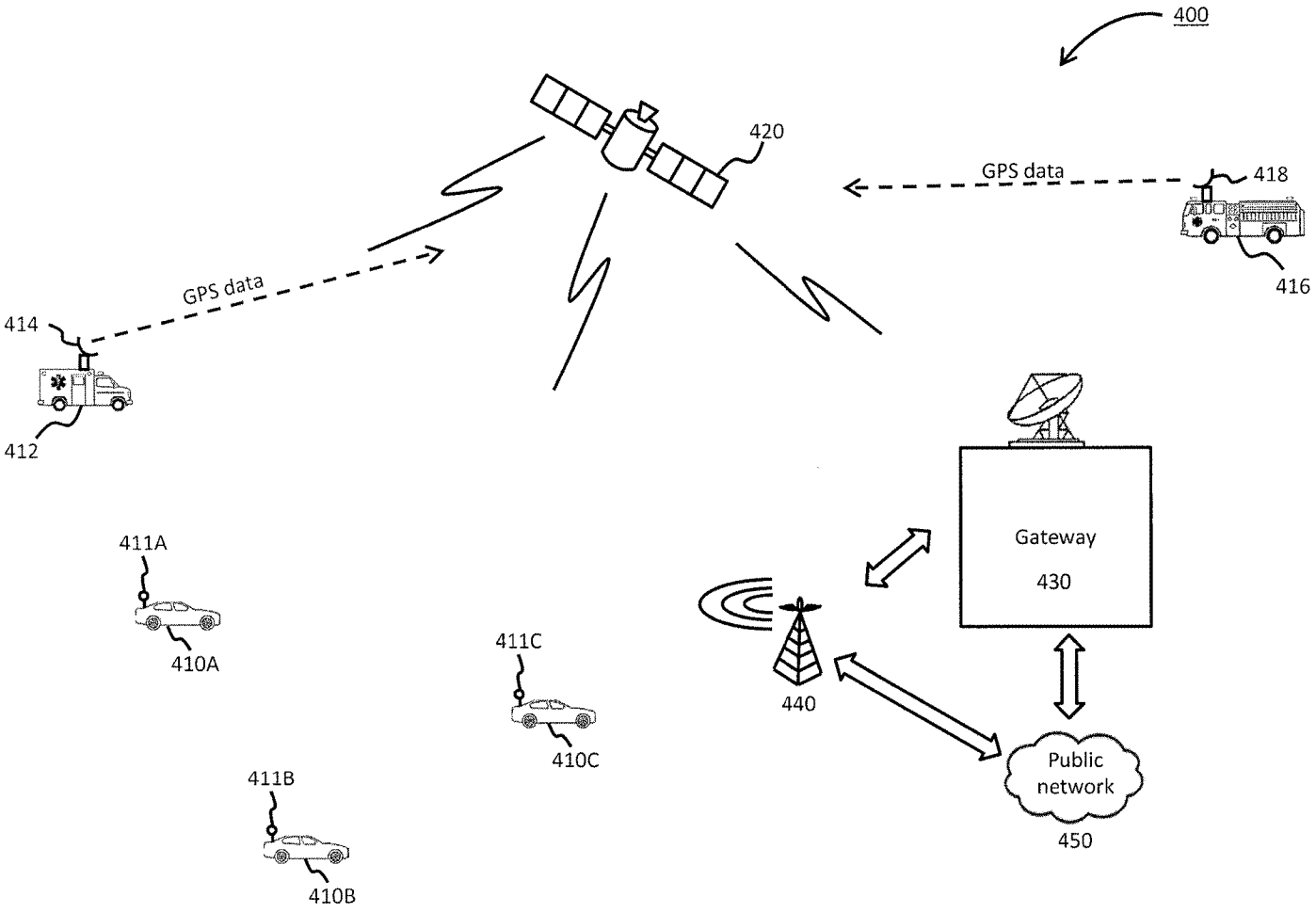
FIG. 4 is a diagram of a system capable of alerting drivers to the presence of oncoming emergency vehicles, according to one or more embodiments.

FIG. 4 illustrates a system 400 for raising awareness to approaching emergency vehicles in accordance with one or more embodiments. The system 400 depicts various ways in which automobiles 410A, 410B, 410C (collectively 410) and can receive GPS information from emergency vehicles such as an ambulance 412 and a fire truck 416. In contrast to the previous embodiment, the system 400 of FIG. 4 provides alternative methods in which the emergency vehicles 412, 416 can supply their GPS information. According to an embodiment, the ambulance 412 can include a specialized transceiver 414 (or transmitter) which allows it to transmit information directly to a satellite 420. Similarly, the fire truck 416 includes a transceiver 418 (or transmitter) which allows it to transmit GPS information directly to the satellite 420. Upon receiving the GPS information from the emergency vehicles 412, 416, the satellite 420 can broadcast the received GPS information directly to any recipients within its coverage beams.

As illustrated in FIG. 4, three automobiles 410A-410C are within the satellite's coverage beam. According to one or more embodiments, each automobile 410 can include a receiver 411 specifically configured to receive transmissions from the satellite 420. Accordingly, when the automobiles 410 are within coverage beams of the satellite 420, they will receive GPS information pertaining to emergency vehicles 412, 416 in the system 400. Using the GPS information, each automobile 410 can determine the location of any emergency vehicles 412, 416 that are within its predetermined proximity. If an emergency vehicle 412, 416 is within the proximity of an automobile 410, then an interrupt signal can be output to the automobile's infotainment system. As previously discussed, the infotainment system can then selectively attenuate various audio and/or video signals that are currently being output within the automobile 410. Additionally, the infotainment system can output various audio messages to provide the driver with additional information regarding the emergency vehicles 412, 414 that are within the predetermined proximity. Various embodiments additionally utilize navigation systems that are incorporated into the infotainment system in order to provide a visual indication as to the location of any approaching emergency vehicles 412, 414.

According to an embodiment, rather than transmitting directly to the automobiles 410, the GPS information can be transmitted to a gateway 430 associated with the satellite 420. The gateway 430 can subsequently utilize various methodologies to supply the GPS information to one or more transmission towers 440. For example, the gateway 430 can include various hardware to provide a wired and/or wireless communication link directly to the transmission tower 440. Alternatively, the gateway 430 can use the wired and/or wireless communication links to access a public network 450, such as the internet, in order to supply the GPS information to the transmission tower 440. The transmission tower 440 can be configured, for example, to provide radio frequency transmissions over unused FM channels or public emergency channels. According to such embodiments, it is not necessary for the automobiles 410 to incorporate specialized hardware in order to receive signals directly from the satellite 420. Rather, standard radio hardware associated with the infotainment system can be used to monitor available FM channels and detect transmission of GPS information from the transmission tower 440.

Figure 5:
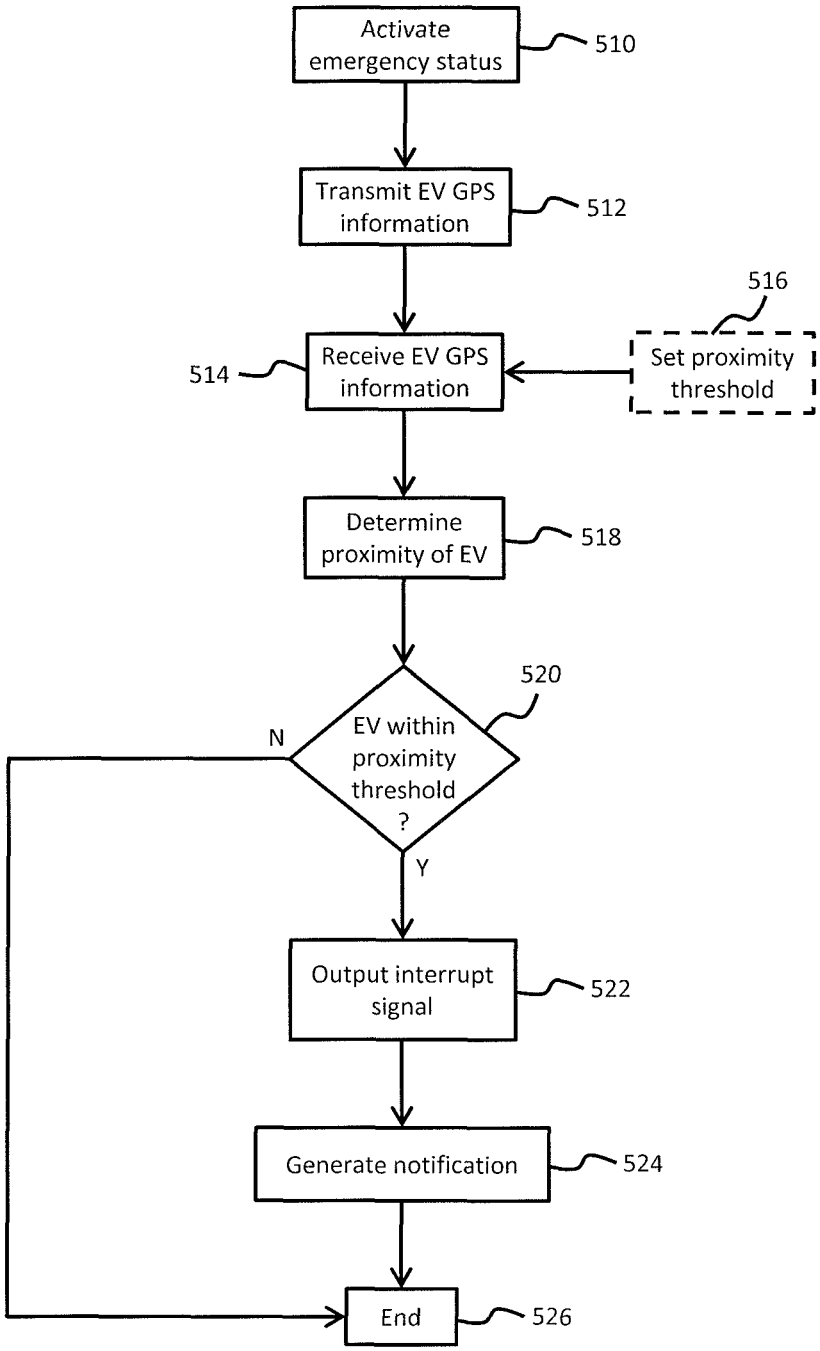
FIG. 5 is a flowchart of a process for alerting drivers to the presence of oncoming emergency vehicles, according to one or more embodiments, according to various embodiments.

FIG. 5 is a flowchart illustrating a process for raising awareness to approaching emergency vehicles, in accordance with at least one embodiment. At 510, the emergency vehicle (EV) activates its emergency status. More particularly, the sirens and/or flashing lights associated with the emergency vehicle would be activated in order to provide both audible and visual alerts to any drivers within its vicinity. At 512, the emergency vehicle initiates transmission of its GPS information. As previously discussed, the GPS information can be continually transmitted in order to provide information corresponding to the real time location of the emergency vehicle.

At 514, automobiles within the range (or proximity) of the emergency vehicle's transmission receive the GPS information. As previously discussed, the proximity threshold for generating the interrupt signal can be varied. Such information can be preset within the automobile itself, or the driver can be provided with an option for manually inputting the proximity threshold. This is illustrated at 516 where the proximity threshold is optionally set. At 518, the automobile determines the proximity (or relative distance) of the emergency vehicle. This can be done based, at least in part, on the received GPS information and the automobile's actual GPS location. At 520, it is determined whether the emergency vehicle is within the automobile's proximity threshold.

If the emergency vehicle is within the proximity threshold of the automobile, then control passes to 522. An interrupt signal is generated in response to the determination that the emergency vehicle is within the proximity threshold. As previously discussed, the interrupt signal can be output directly to the automobile's infotainment system. According to further embodiments, a separate controller or computing hardware associated with the automobile's transceiver can be utilized to receive the interrupt signal and supply commands and information sufficient to fully or partially control operation of the infotainment system. For example, a general processor, Digital Signal Processing (DSP) chip, Application Specific Integrated Circuit (ASIC), Field Programmable Gate Array (FPGA), etc. (as described in greater detail below) can be utilized for controlling the automobile's infotainment system.

At 524, the infotainment system generates a notification to alert the driver that an emergency vehicle is within its vicinity. As previously discussed, the notification can include a variety of activities. For example, select audio and/or video signals that are currently being output by the infotainment system can be attenuated or completely disabled. Alternatively, only audio and video signals that are perceivable by the driver can be attenuated or completely disabled. Thus, the infotainment system can continue to output audio and/or video signals being supplied only to rear passengers, particularly those utilizing headsets to receive audio signals. Furthermore, various audio and/or video warnings (or alerts) can be provided to the driver. The process ends at 526. Returning to 520, if it is determined that the emergency vehicle is not within the proximity threshold of the automobile, control would also pass to 526 where the process would also end.

Figure 6:
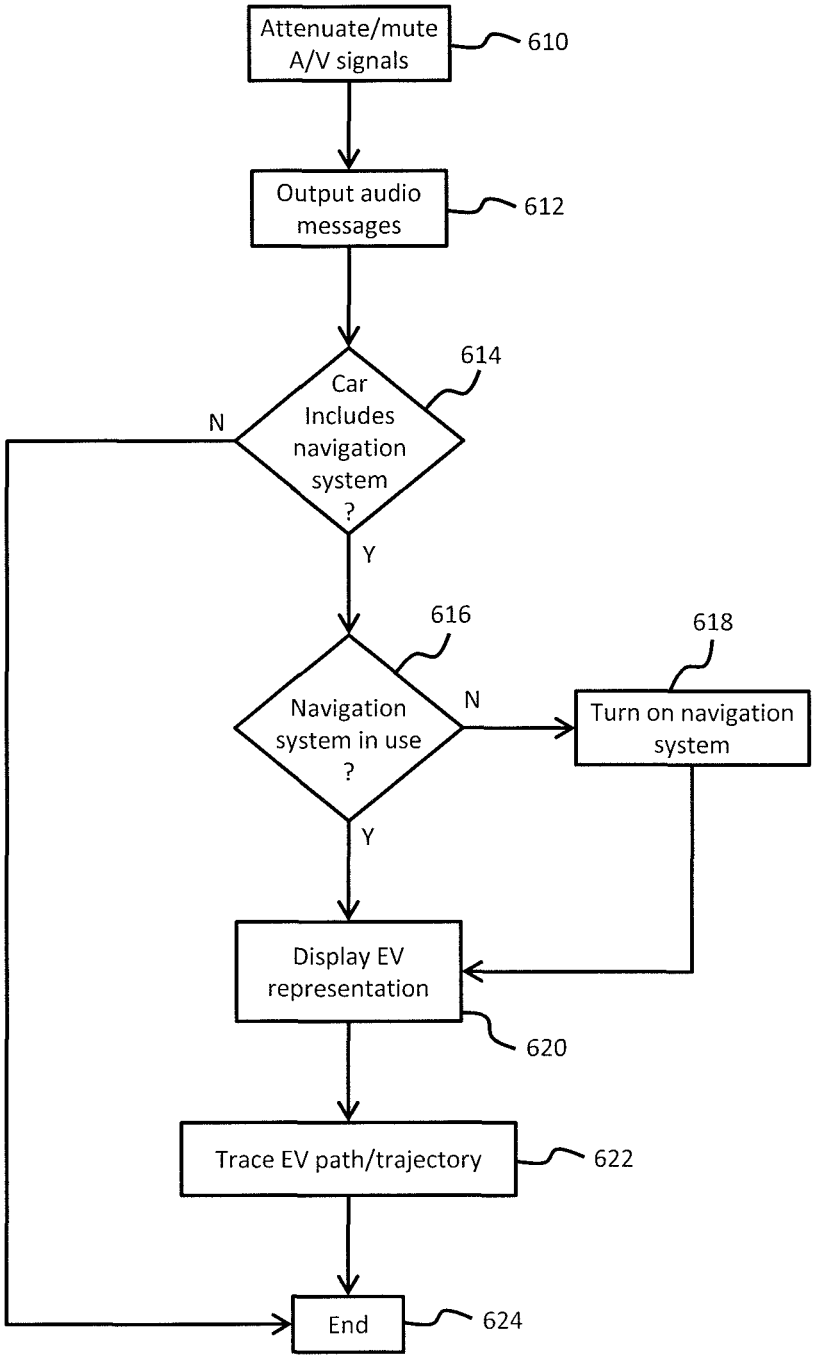
FIG. 6 is a flowchart of a process for illustrating output of different alerts, according to one or more embodiments.

FIG. 6 is a flowchart illustrating the manner in which various notifications can be generated and supplied to a driver, in accordance with various embodiments. At 610, audio and/or video signals being output by the infotainment system can be selectively attenuated or muted. At 612, one or more audio messages are output to the driver. For example, the audio messages can indicate the distance from the emergency vehicle, the speed of the emergency vehicle, the travel direction of the emergency vehicle, etc. At 614, it is determined whether the automobile includes a navigation system as part of its infotainment system. If a navigation system is not available, then control passes to 624 where the process ends.

If a navigation system is included as part of the infotainment system, then control passes to 616 where it is determined whether or not the navigation system is currently in use. If the navigation system is not currently being used, it is turned on, or activated, at 618. At 620, a representation of the emergency vehicle is displayed on the navigation screen. As previously discussed, this can be in the form of an icon representative of the type of emergency vehicle that is being approached. According to other embodiments, however, a generic icon can be used to represent all types of emergency vehicles.

At 622, the path and/or trajectory of the emergency vehicle is plotted on the navigation screen. For example, the GPS information that is received can be continually updated and used to trace a path indicating the direction in which the emergency vehicle has traveled up to the current instant in time. According to various embodiments, however, the projected trajectory of the emergency vehicle can be displayed on the navigation screen in addition to the traveled path. An option can also be provided to the driver for selectively displaying the traveled path, projected path, or both. Such features can provide the driver with a visual indication of potential intersections that can give rise to a collision with the emergency vehicle. The process subsequently ends at 624.

Various features described herein may be implemented via software, hardware (e.g., general processor, Digital Signal Processing (DSP) chip, an Application Specific Integrated Circuit (ASIC), Field Programmable Gate Arrays (FPGAs), etc.), firmware or a combination thereof. For example, such hardware can be incorporated into the previously described receivers, transmitters, transceivers, infotainment systems, gateway, transmission tower, automobile, emergency vehicles, etc. Additionally, such hardware can be interfaced to connect and/or facilitate communication between different components such as the automobile infotainment system and receiver.

The terms software, computer software computer program, program code, and application program may be used interchangeably and are generally intended to include any sequence of machine or human recognizable instructions intended to program/configure a computer, processor, server, etc. to perform one or more functions. Such software can be rendered in any appropriate programming language or environment including, without limitation: C, C++, C#, Python, R, Fortran, COBOL, assembly language, markup languages (e.g., HTML, SGML, XML, VoXML), Java, JavaScript, etc. As used herein, the terms processor, microprocessor, digital processor, and CPU are meant generally to include all types of processing devices including, without limitation, single/multi-core microprocessors, digital signal processors (DSPs), reduced instruction set computers (RISC), general-purpose (CISC) processors, gate arrays (e.g., FPGAs), PLDs, reconfigurable compute fabrics (RCFs), array processors, secure microprocessors, and application-specific integrated circuits (ASICs). Such digital processors may be contained on a single unitary IC die, or distributed across multiple components. Such exemplary hardware for implementing the described features are detailed below.

Figure 7:
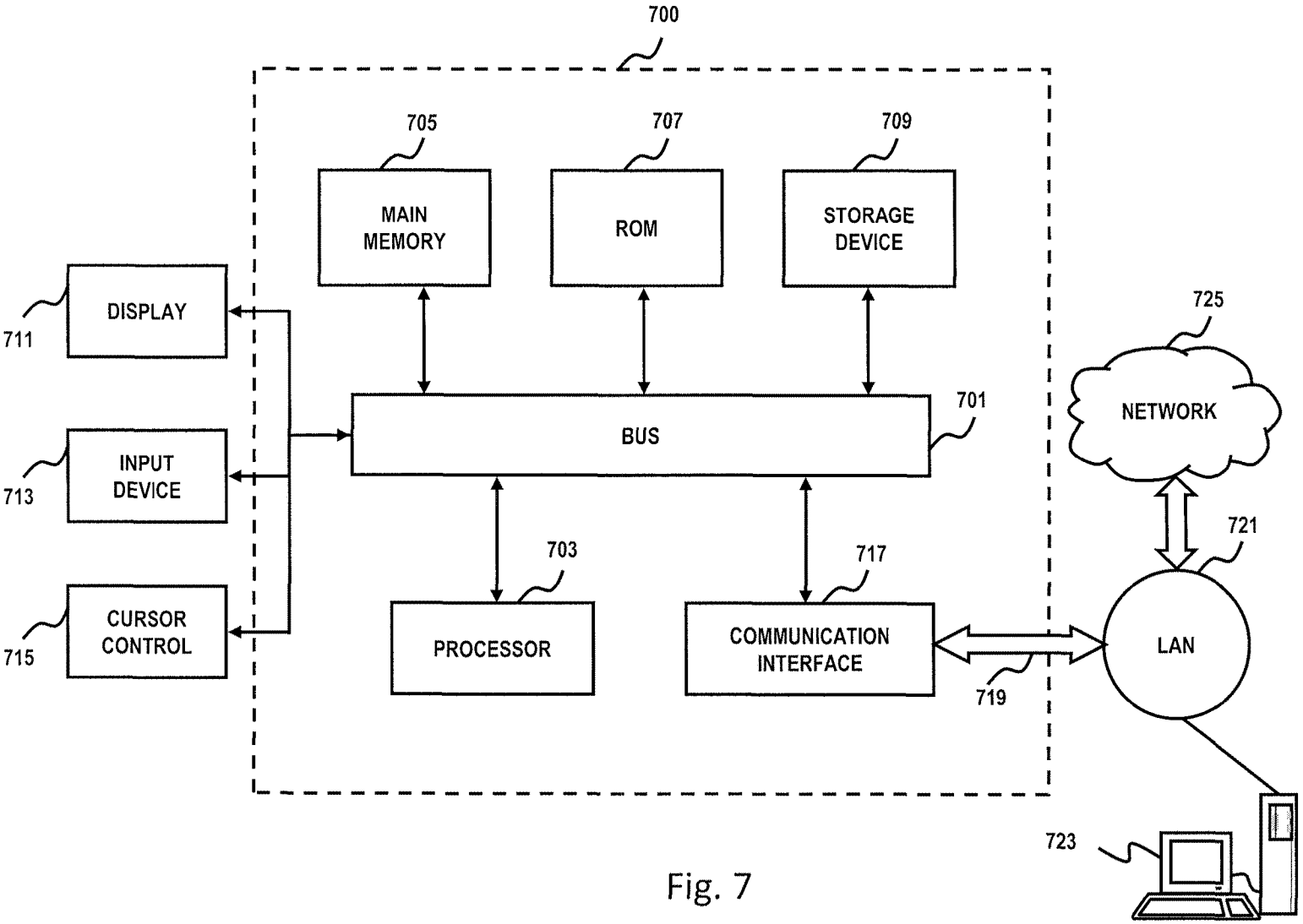
FIG. 7 is a diagram of a computer system that can be used to implement various exemplary embodiments.

FIG. 7 is a diagram of a computer system that can be used to implement various embodiments. The computer system 700 includes a bus 701 or other communication mechanism for communicating information and a processor 703 coupled to the bus 701 for processing information. The computer system 700 also includes main memory 705, such as a random access memory (RAM), dynamic random access memory (DRAM), synchronous dynamic random access memory (SDRAM), double data rate synchronous dynamic random-access memory (DDR SDRAM), DDR2 SDRAM, DDR3 SDRAM, DDR4 SDRAM, etc., or other dynamic storage device (e.g., flash RAM), coupled to the bus 701 for storing information and instructions to be executed by the processor 703. Main memory 705 can also be used for storing temporary variables or other intermediate information during execution of instructions by the processor 703. The computer system 700 may further include a read only memory (ROM) 707 or other static storage device coupled to the bus 701 for storing static information and instructions for the processor 703. A storage device 709, such as a magnetic disk or optical disk, is coupled to the bus 701 for persistently storing information and instructions.

The computer system 700 may be coupled via the bus 701 to a display 711, such as a light emitting diode (LED) or other flat panel displays, for displaying information to a computer user. An input device 713, such as a keyboard including alphanumeric and other keys, is coupled to the bus 701 for communicating information and command selections to the processor 703. Another type of user input device is a cursor control 715, such as a mouse, a trackball, or cursor direction keys, for communicating direction information and command selections to the processor 703 and for controlling cursor movement on the display 711. Additionally, the display 711 can be touch enabled (i.e., capacitive or resistive) in order facilitate user input via touch or gestures.

According to an exemplary embodiment, the processes described herein are performed by the computer system 700, in response to the processor 703 executing an arrangement of instructions contained in main memory 705. Such instructions can be read into main memory 705 from another computer-readable medium, such as the storage device 709. Execution of the arrangement of instructions contained in main memory 705 causes the processor 703 to perform the process steps described herein. One or more processors in a multi-processing arrangement may also be employed to execute the instructions contained in main memory 705. In alternative embodiments, hard-wired circuitry may be used in place of or in combination with software instructions to implement exemplary embodiments. Thus, exemplary embodiments are not limited to any specific combination of hardware circuitry and software.

The computer system 700 also includes a communication interface 717 coupled to bus 701. The communication interface 717 provides a two-way data communication coupling to a network link 719 connected to a local network 721. For example, the communication interface 717 may be a digital subscriber line (DSL) card or modem, an integrated services digital network (ISDN) card, a cable modem, fiber optic service (FiOS) line, or any other communication interface to provide a data communication connection to a corresponding type of communication line. As another example, communication interface 717 may be a local area network (LAN) card (e.g. for Ethernet™ or an Asynchronous Transfer Mode (ATM) network) to provide a data communication connection to a compatible LAN. Wireless links can also be implemented. In any such implementation, communication interface 717 sends and receives electrical, electromagnetic, or optical signals that carry digital data streams representing various types of information. Further, the communication interface 717 can include peripheral interface devices, such as a Universal Serial Bus (USB)

interface, a High Definition Multimedia Interface (HDMI), etc. Although a single communication interface 717 is depicted in FIG. 7, multiple communication interfaces can also be employed.

The network link 719 typically provides data communication through one or more networks to other data devices. For example, the network link 719 may provide a connection through local network 721 to a host computer 723, which has connectivity to a network 725 such as a wide area network (WAN) or the Internet. The local network 721 and the network 725 both use electrical, electromagnetic, or optical signals to convey information and instructions. The signals through the various networks and the signals on the network link 719 and through the communication interface 717, which communicate digital data with the computer system 700, are exemplary forms of carrier waves bearing the information and instructions.

The computer system 700 can send messages and receive data, including program code, through the network(s), the network link 719, and the communication interface 717. In the Internet example, a server (not shown) might transmit requested code belonging to an application program for implementing an exemplary embodiment through the network 725, the local network 721 and the communication interface 717. The processor 703 may execute the transmitted code while being received and/or store the code in the storage device 709, or other non-volatile storage for later execution. In this manner, the computer system 700 may obtain application code in the form of a carrier wave.

The term "computer-readable medium" as used herein refers to any medium that participates in providing instructions to the processor 703 for execution. Such a medium may take many forms, including but not limited to non-volatile media, volatile media, and transmission media. Non-volatile media include, for example, optical or magnetic disks, such as the storage device 709. Non-volatile media can further include flash drives, USB drives, microSD cards, etc. Volatile media include dynamic memory, such as main memory 705. Transmission media include coaxial cables, copper wire and fiber optics, including the wires that comprise the bus 701. Transmission media can also take the form of acoustic, optical, or electromagnetic waves, such as those generated during radio frequency (RF) and infrared (IR) data communications. Common forms of computer-readable media include, for example, a USB drive, microSD card, hard disk drive, solid state drive, optical disk (e.g., DVD, DVD RW, Blu-ray), or any other medium from which a computer can read.

Figure 8:
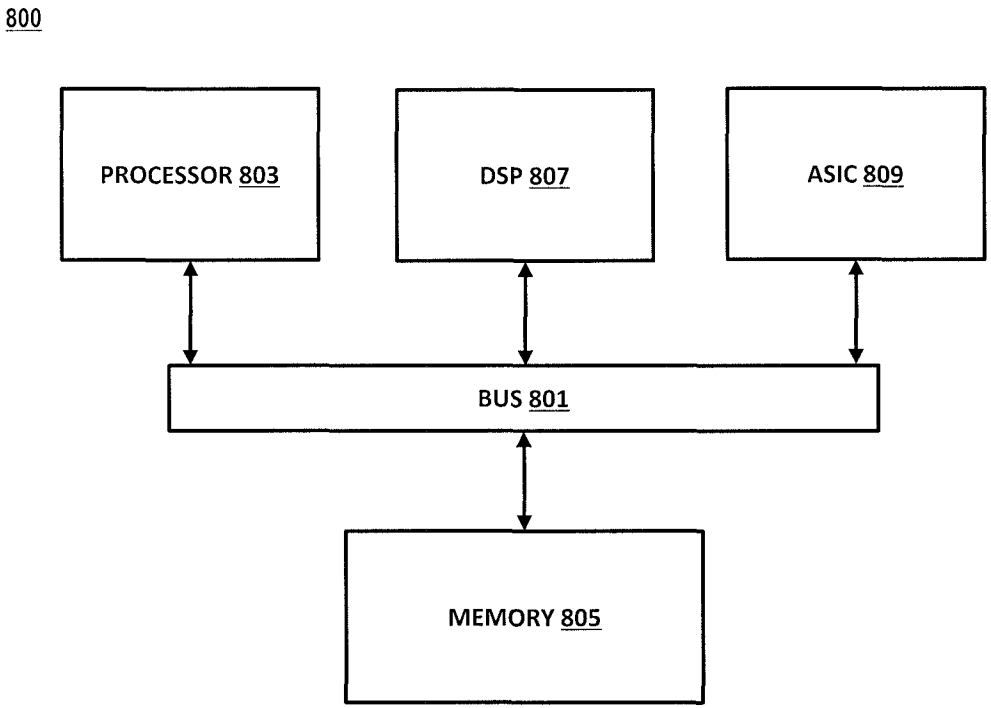
FIG. 8 is a diagram of a chip set that can be used to implement various exemplary embodiments.

FIG. 8 illustrates a chip set 800 upon which an embodiment of the invention may be implemented. Chip set 800 is programmed to implement various features as described herein and includes, for instance, the processor and memory components described with respect to FIG. 8 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip. Chip set 800, or a portion thereof, constitutes a means for performing one or more steps of the figures.

In one embodiment, the chip set 800 includes a communication mechanism such as a bus 801 for passing information among the components of the chip set 800. A processor 803 has connectivity to the bus 801 to execute instructions and process information stored in, for example, a memory 805. The processor 803 may include one or more processing cores with each core configured to perform independently. A multi-core processor enables multiprocessing within a single physical package. Examples of a multi-core processor include two, four, eight, or greater numbers of processing cores. Alternatively or in addition, the processor 803 may include one or more microprocessors configured in tandem via the bus 801 to enable independent execution of instructions, pipelining, and multithreading. The processor 803 may also be accompanied with one or more specialized components to perform certain processing functions and tasks such as one or more digital signal processors (DSP) 807, or one or more application-specific integrated circuits (ASIC) 809. A DSP 807 typically is configured to process real-world signals (e.g., sound) in real time independently of the processor 803. Similarly, an ASIC 809 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 803 and accompanying components have connectivity to the memory 805 via the bus 801. The memory 805 includes both dynamic memory (e.g., RAM, magnetic disk, re-writable optical disk, etc.) and static memory (e.g., ROM, CD-ROM, DVD, BLU-RAY disk, etc.) for storing executable instructions that when executed perform the inventive steps described herein to controlling a set-top box based on device events. The memory 805 also stores the data associated with or generated by the execution of the inventive steps.

While certain exemplary embodiments and implementations have been described herein, other embodiments and modifications will be apparent from this description. Accordingly, the various embodiments described are not intended to be limiting, but rather are encompassed by the broader scope of the presented claims and various obvious modifications and equivalent arrangements.

What is claimed is:

1. A method comprising:

transmitting, from an emergency vehicle, information corresponding, at least in part, to GPS coordinates of the emergency vehicle;

receiving the transmitted information at an automobile;

determining a proximity of the emergency vehicle relative to the automobile based, at least in part, on the received information;

outputting an interrupt signal to an infotainment system in the automobile, if the emergency vehicle is within a predetermined proximity thereof;

selectively attenuating audio and video signals currently being output by the infotainment system in response to the interrupt signal, thereby raising driver awareness to audio/video alerts generated by the emergency vehicle;

activating a navigation system within the automobile;

displaying a visual representation of the emergency vehicle on a map of the navigation system by tracing a traveled path and simultaneously tracing multiple projected paths of the emergency vehicle on the map; and eliminating one or more of the multiple projected paths of the emergency vehicle, based on an instantaneous position of the emergency vehicle.

2. The method of claim 1, further comprising outputting at least one audio message inside the automobile to indicate at least one of a distance to the emergency vehicle and a travel direction of the emergency vehicle.

3. The method of claim 1, wherein the transmitting comprises:

transmitting, from at least one emergency vehicle to a satellite, information corresponding, at least in part, to GPS coordinates of the at least one emergency vehicle; and broadcasting, from the satellite to one or more automobiles, the GPS coordinates of the at least one emergency vehicle.

4. The method of claim 1, wherein the transmitting comprises:

transmitting, from at least one emergency vehicle to at least one of a mobile network or a base station of a satellite communication system, information corresponding, at least in part, to GPS coordinates of the at least one emergency vehicle; and broadcasting, from the mobile network and/or the base station to one or more automobiles, the GPS coordinates of the at least one emergency vehicle.

5. The method of claim 1, wherein the emergency vehicle transmits the information over an open FM radio band, and further comprising tuning the infotainment system to the open FM radio band in response to the interrupt signal.

6. The method of claim 1, wherein the predetermined proximity is automatically set based, at least in part, on a speed and/or heading of the automobile.

7. The method of claim 1, further comprising manually setting the predetermined proximity.

8. The method of claim 1, wherein displaying a visual representation further comprises:

displaying all potential points of collision on the map; and continuously updating the potential points of collision in real time.

9. A system comprising:

a first transceiver located in an emergency vehicle for transmitting information corresponding, at least in part, to GPS coordinates of the emergency vehicle; and a second transceiver located in an automobile and configured to:

receive the transmitted information, determine a proximity of the emergency vehicle relative to the automobile based, at least in part, on the received information, output an interrupt signal, if the emergency vehicle is within a predetermined proximity thereof, cause an infotainment system to selectively attenuate audio and video signals currently being output in response to the interrupt signal, thereby raising driver awareness to audio/video alerts generated by the emergency vehicle, activate a navigation system within the automobile, and cause the navigation system to display a visual representation of the emergency vehicle on a map thereof by tracing a traveled path and simultaneously trace multiple projected paths of the emergency vehicle on the map; and eliminate one or more of the multiple projected paths of the emergency vehicle, based on an instantaneous position of the emergency vehicle.

10. The system of claim 9, wherein the second transceiver is further configured to cause the infotainment system to output an audio message inside the automobile to indicate at least one of a distance to the emergency vehicle and a travel direction of the emergency vehicle.

11. The system of claim 9, further comprising:

a satellite, wherein, the first transceiver is configured to transmit the information to the satellite, and wherein the satellite is configured to broadcast the GPS coordinates of the emergency vehicle to one or more automobiles.

12. The system of claim 9, wherein:

the first transceiver is configured to transmit the information to at least one of a mobile network or a base station of a satellite communication system; and the second transceiver is configured to receive the information when it is broadcast by the mobile network and/or the base station.

13. The system of claim 9, wherein:

the first transceiver is configured to transmit the information over an open FM radio band; and the second transceiver is further configured to cause the infotainment system to tune to the open FM radio band in response to the interrupt signal.

14. The system of claim 9, wherein the second transceiver is further configured to automatically set the predetermined proximity based, at least in part, on a speed and/or heading of the automobile.

15. The system of claim 9, wherein the second transceiver is further configured to receive, as input, a value for the predetermined proximity.

16. The system of claim 9, further comprising a middleware circuit interfaced to the infotainment system and configured to cause the infotainment system to selectively attenuate audio and video signals currently being output in response to the interrupt signal, thereby raising driver awareness to audio/video alerts generated by the emergency vehicle.

17. The system of claim 9, wherein the second transceiver is further configured to:

display all potential points of collision on the map; and continuously update the potential points of collision in real time.

* * * * *